United States Patent [19]

Walters

[11] 4,183,416

[45] Jan. 15, 1980

[54] CUTTER ACTUATED ROCK BIT LUBRICATION SYSTEM

[75] Inventor: D. F. Walters, Dallas, Tex.

[73] Assignee: Dresser Industries, Inc., Dallas, Tex.

[21] Appl. No.: 934,930

[22] Filed: Aug. 18, 1978

[51] Int. Cl.[2] ..... E21B 9/08; E21B 9/35

[52] U.S. Cl. ..... 175/229; 175/228; 175/337; 175/371; 308/8.2

[58] Field of Search ..... 175/227, 228, 229, 337, 175/371, 372; 308/8.2; 184/31

[56] References Cited

U.S. PATENT DOCUMENTS

| | | | |
|---|---|---|---|
| 1,010,143 | 11/1911 | Hughes | 175/228 |
| 2,625,885 | 1/1953 | Mumma | 184/31 X |
| 3,244,459 | 4/1966 | Ortloff | 175/229 X |
| 3,251,634 | 5/1966 | Dareing | 175/228 |
| 3,659,663 | 5/1972 | Dyjart | 175/337 X |
| 3,841,422 | 10/1974 | Crow | 175/229 |
| 3,844,364 | 10/1974 | Crow | 175/228 |

*Primary Examiner*—Ernest R. Purser
*Assistant Examiner*—Nick A. Nichols, Jr.
*Attorney, Agent, or Firm*—Eddie E. Scott

[57] ABSTRACT

Lubricant is circulated from a lubricant reservoir to the bearings of a rotary rock bit and back to the lubricant reservoir by a lubricant circulation system that is operated by rotation of the cone cutter upon the bearing pin of the bit. A seal is positioned between the rolling cone cutter and the arm of the bit to maintain lubricant in the bearing area and to prevent fluid and materials in the borehole from entering the bearing area. A lubricant reservoir is located in the bit body. A first passage connects the lubricant reservoir with the bearing area to channel lubricant from the lubricant reservoir to the bearing area. A second passage extends from the bearing area to the lubricant reservoir to allow lubricant to be channeled back to the lubricant reservoir. A spiral screw connected to the cone cutter extends into a passage in the bearing pin and provides a pumping action as the cone cutter rotates to circulate lubricant from the lubricant reservoir through said first passage to the bearing area and from the bearing area through said second passage back to said lubricant reservoir.

3 Claims, 2 Drawing Figures

CUTTER ACTUATED ROCK BIT LUBRICATION SYSTEM

TECHNICAL FIELD

The present invention relates to the art of earth boring and, more particularly, to a rolling cutter earth boring bit with a system for circulating lubricant from a lubricant reservoir to the bearing area and back to the lubricant reservoir. The present invention is especially adapted for use with rock bits popularly known as three cone rotary rock bits; however, its use is not restricted thereto, and the present invention can be used in other types of rotary rock bits.

BACKGROUND OF THE INVENTION

A three cone rotary rock bit consists of a main bit body adapted to be connected to a rotary drill string. The bit includes three individual rotatable cone cutters mounted on three individual bearing pins extending from the main bit body. Bearing systems are provided between the cone cutters and the bearing pins to promote rotation of the cutters and means are provided on the outer surface of the cone cutters for disintegrating the earth formations as the bit and the cutters rotate. A supply of undeteriorated lubricant must be maintained proximate the bearing systems throughout the lifetime of the bit. By circulating the lubricant from a reservoir to the bearings and back to the reservoir, the life of the lubricant will be increased and a larger volume of lubricant will be exposed to the bearing surfaces.

A three cone rotary rock bit must operate under very severe conditions, and the size and geometry of the bit is restricted by the operating characteristics. At the same time, the economics of petroleum production demand a longer lifetime and improved performance from the bit. In attempting to provide an improved bit, new and improved materials have been developed for the cutting structure of the cone cutters. They have provided a longer useful lifetime for the cone cutters. This has resulted in the bearing systems of the bit being often the first to fail during the drilling operation. Consequently, a need exists for new and improved lubrication systems and bearing systems to extend the useful lifetime of the bit and to allow development of other elements that interact with the lubrication and bearing systems. In attempting to provide a new lubrication system, great care must be taken that the overall capacity of the bearing systems is not reduced.

DESCRIPTION OF PRIOR ART

In U.S. Pat. No. 3,244,451 to J. E. Ortloff, patented Apr. 5, 1966, a lubricating system for extending the life of the bearings of a roller cone type bit is shown. Sealing means are provided to effectively separate or close off the clearance between the journal of the leg and the bearings of the roller cone from the exterior of the bit. A special pump means is provided to circulate the lubricating fluid under high pressure through this sealed-off clearance space. The pump means is actuated by the rotation of the roller cone element on the shaft.

In U.S. Pat. No. 3,251,634 to W. D. Dareing, patented May 17, 1966, a lubricating system for extending the life of the bearings of a roller cone type bit is shown. Sealing means are provided to effectively separate or close off the clearance or space between the journal of the leg and the bearings of the roller cone from the exterior of the bit. An electrical pump means is provided to supply a lubricating fluid under high pressure to this sealed-off clearance space.

In U.S. Pat. No. 3,841,422 to M. L. Crow, patented Oct. 15, 1974, a dynamic rock bit lubrication system is shown. Lubricant is circulated from a lubricant reservoir to the bearings of a rotary rock bit and back to the lubricant reservoir by a lubricant circulation system that is operated by movement of the cone cutter upon the bearing pin of the bit. A positive seal is positioned between the rolling cone cutter and the arm of the bit to maintain lubricant in the bearing area and to prevent fluid in the borehole from entering the bearing area. A lubricant reservoir is located in the bit body. A first passage connects the lubricant reservoir with the bearing area to channel lubricant from the lubricant reservoir to the bearing area. A second passage extends from the bearing area to the lubricant reservoir to allow lubricant to be channeled back to the lubricant reservoir. A check valve in at least one of said passages insures one-way flow of lubricant. Axial movement of the cone cutter on the bearing pin provides a pumping action to circulate lubricant from the lubricant reservoir through said first passage to the bearing area and from the bearing area through said second passage back to said lubricant reservoir.

In U.S. Pat. No. 3,844,364 to M. L. Crow, patented Oct. 29, 1974, a hydrostatic rock bit lubrication system is shown. Lubricant is circulated from a lubricant reservoir to the bearings of a rock bit and back to the lubricant reservoir by a lubricant pump that is operated by periodic fluid pressure variations. A pumping chamber is located in the bit body. A movable pumping element is positioned in the pumping chamber. A first side of the pumping element is exposed to the pressure of the drilling fluid. Passages are provided to channel the lubricant from the lubricant reservoir to the bearing systems and back to the lubricant reservoir. The second side of the pumping element is exposed to lubricant in the passages. Check valves in the passages provide one-way flow of lubricant. Periodic pressure variations in the drilling fluid create a reciprocating motion of the pumping element causing the lubricant to be circulated through the passages.

SUMMARY OF THE INVENTION

The present invention provides a lubricant circulation system for a rotary rock bit. Lubricant is circulated from a lubricant reservoir to the bearings of the bit and back to the lubricant reservoir by a lubricant circulation system that is operated by rotation of the cone cutter upon the bearing pin. A seal is positioned between the rolling cone cutter and the arm of the bit to maintain lubricant in the bearing area and to prevent fluid in the borehole from entering the bearing area. A lubricant reservoir is located in the bit body. A first passage connects the lubricant reservoir with the bearing area to channel lubricant from the lubricant reservoir to the bearing area. A second passage extends from the bearing area to the lubricant reservoir to allow lubricant to be channeled back to the lubricant reservoir. A pumping system operated by the cone cutter rotating on the bearing pin provides a pumping action to circulate lubricant from the lubricant reservoir through said first passage to the bearing area and from the bearing area through said second passage back to said lubricant reservoir. The above and other features and advantages of the present invention will become apparent upon consideration of the following detailed description of the invention when taken in conjunction with the accompanying drawings.

DETAILED DESCRIPTION OF THE INVENTION

Figure 1:
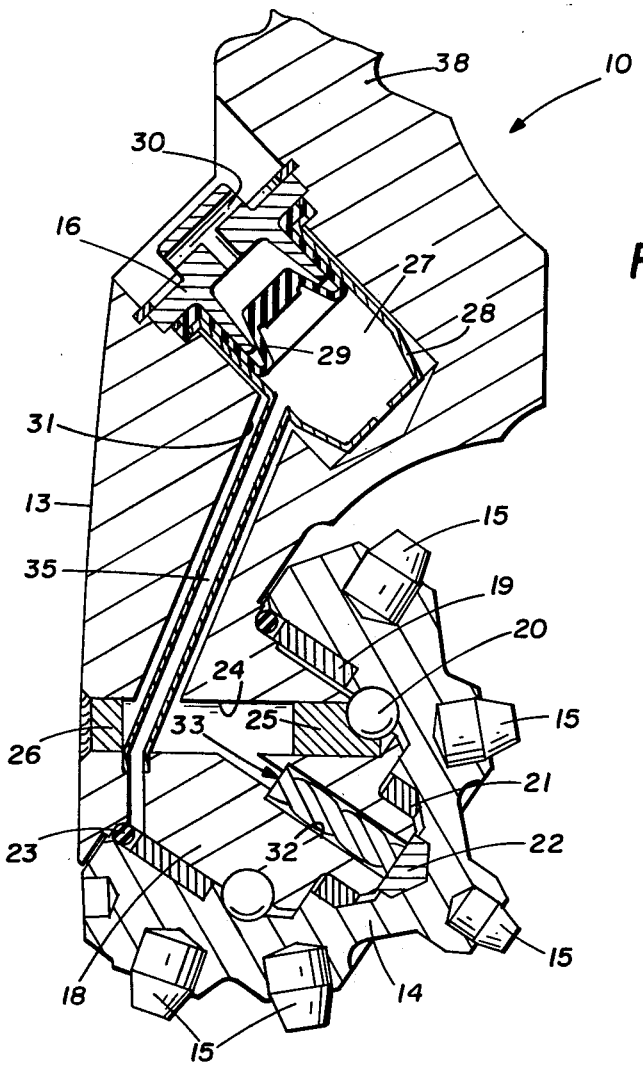
FIG. 1 is a sectional view of one arm of an earth boring bit constructed in accordance with the present invention.

Referring now to FIG. 1, a sectional view of one arm 13 of a three cone rotary rock bit 10 is shown. It is to be understood that the structures of the other two arms are substantially identical to the arm 13. A cutter 14 is rotatably positioned on the journal portion of bearing pin 18 of the arm 13 and adapted to disintegrate the earth formations as the bit 10 is rotated. The cutting structure 15 on the surface of cutter 14 contacts and disintegrates the formations in a manner that is well known in the art. The cutting structure 15 is shown in the form of tungsten carbide inserts. However, it is to be understood that other cutting structures such as steel teeth may be used as the cutting structure on the cone cutter 14.

The body of the bit 10 includes an upper threaded portion that allows the bit 10 to be connected to the lower end of a rotary drill string (not shown). The bit 10 also includes a central passageway extending along the central axis of the bit to allow drilling fluid to enter from the upper section of the drill string (not shown) immediately above and pass downward to the bottom of the well bore to flush cuttings and drilling debris from the well bore.

A plurality of bearing systems are located in the bearing area between the cutter 14 and the bearing pin 18. The bearing systems in the bearing area include an outer friction bearing 19, a series of ball bearings 20, an inner friction bearing 21, and a thrust button 22. An O-ring seal 23 is positioned between the cutter 14 and the bearing pin 18. This seal retains lubricant in the bearing area around the bearing systems and prevents any materials in the well bore from entering the bearing area. A passageway 24 allows the balls that make up the ball bearing system 20 to be inserted into position after the cone cutter 14 is placed on the bearing pin 18. The series of ball bearings 20 serves to lock the cone cutter 14 on the bearing pin 18. After the balls are in place, a plug 25 is inserted into the passageway 24 and retained therein by a force fit to close passage 24. An outer plug 26 is inserted in passage 24 and welded therein.

A cylindrical reservoir chamber is located in the bit body 11. A lubricant reservoir 27 containing a suitable lubricant is positioned in the lubricant reservoir chamber. The lubricant reservoir 27 consists of a lubricant reservoir canister 28 with a flexible diaphragm 29 attached. A reservoir cap 16 closes the reservoir chamber. A vent passage 30 allows the pressure of the fluid in the borehole to be transmitted to the outside of the flexible diaphragm 29. A first passage made up of passage 31, passage 24 and passage 32 extends from the lubricant reservoir 27 to the bearing area between the cutter 14 and the bearing pin 18. A second passage 35 extends from the lubricant reservoir 27 to the bearing area. Lubricant in the lubricant reservoir 27 can flow through the first passage, comprising passages 31, 24 and 32 to the bearing area. Lubricant in the bearing area between the cutter 14 and the bearing pin 18 can flow through the second passage 35 back to the lubricant reservoir 27.

The present invention provides a system for circulating the lubricant from the lubricant reservoir 27 through the bearing area. The lubricant in the prior art bearings deteriorates and does not furnish proper lubrication. By circulating the lubricant from the reservoir 27 through the bearing area, the life of the lubricant will be increased by exposing a larger amount of lubricant to the bearing surfaces. The present invention provides spiral screw pumping system connected to the cone cutter 14 that operates as a pump when the cutter 14 is rotating on the bearing pin 18. A bore or passage 32 extends from the end of bearing pin 18 to the passage 24. The major portion of the bore or passage 32 is enlarged to receive the pumping element. A spiral screw pumping element 33 attached to the thrust button 22 of cutter 14 extends into the bore or passage 32. The spiral screw produces a positive pumping action that forces lubricant from the lubricant reservoir through the passages 31, 24 and 32 into the bearing area and from the bearing area back to the reservoir through passage 35.

Figure 2:
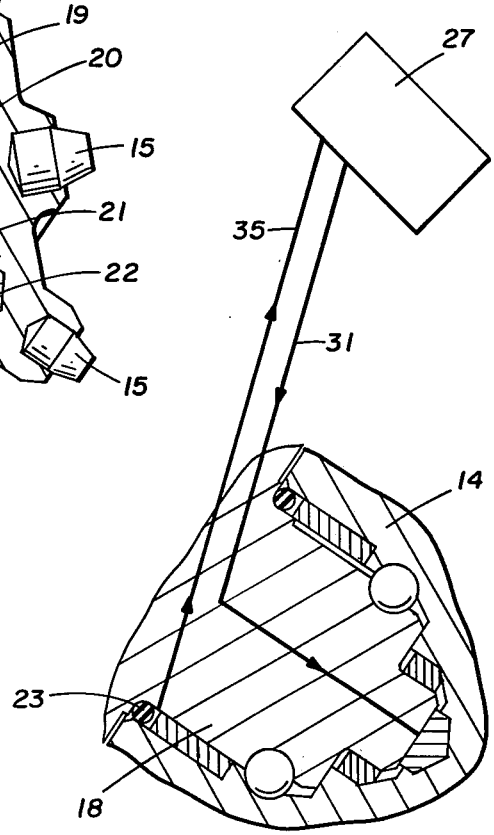
FIG. 2 is a schematic diagram of the lubricant circulation system of the present invention.

The structural details of an earth boring bit 10 constructed in accordance with the present invention having been described, the operation of the bit 10 will now be considered with reference to FIG. 2. The lubrication system of the bit 10 is filled with a suitable lubricant. The bit is rotated and thrust downward, thrusting the cutter 14 against the earth formations. Continued rotation with the drill string applying a thrust force to the bit 10 causes the cutters to disintegrate the formations and form the desired borehole. Lubricant is circulated from the lubricant reservoir 27 to the bearings of the bit and back to the lubricant reservoir 27 by the lubricant circulation system operated by rotation of the cone cutter 14 upon the bearing pin 18 of the bit. The seal 23 positioned between the rolling cone cutter 14 and the bearing pin 18 of the bit maintains lubricant in the bearing area and prevents fluid and materials in the borehole from entering the bearing area. The first passage including passages 31, 24 and 32 connects the lubricant reservoir with the bearing area to channel lubricant from the bearing area to the lubricant reservoir 27. The second passage 35 extends from the bearing area to the lubricant reservoir 27 to allow lubricant to be channeled back to the lubricant reservoir. The spiral screw pumping system operates as a pump when the cutter 14 is rotating on the bearing pin 18 providing a pumping action to circulate lubricant from the lubricant reservoir through the first passage to the bearing area and from the bearing area through said second passage back to the lubricant reservoir.

The embodiments of the invention in which an exclusive property or privilege is claimed are defined as follows:

1. In an earth boring bit including a bit body with a bearing pin extending from said bit body, a rotatable cutter mounted upon said bearing pin, bearing means and seal means between said bearing pin and said cutter, the improvement comprising:

a lubricant circulation system including a lubricant reservoir in said bit body;

first passage means for channeling lubricant from said lubricant reservoir to said bearing means;

second passage means for channeling lubricant from said bearing means to said lubricant reservoir;

a bore extending into said bearing pin, said bore in open communication with said first passage means; and a rotary pump means attached to said rotatable cutter and extending into said bore, said rotary pumping means including a generally cylindrical member with a spiral screw groove, said generally cylindrical member extending from said rotatable cutter for pumping lubricant through said first and second passage means.

2. In an earth boring bit, said earth boring bit including a bit body having a bearing pin, a rotatable cutter, bearing means for promoting rotation of said cutter and a seal between said rotatable cutter and said bit body, a lubricant circulation system, comprising:

a lubricant reservoir in said bit body;

passage means for channeling lubricant from said lubricant reservoir to said bearing means and separate passage means for channeling lubricant from said bearing means to said lubricant reservoir;

a bore in said bearing pin that intersects said passage means; and pump mean positioned in said bore for circulating lubricant through said passage means, said pump means including a cylindrical member with a spiral screw pumping element extending from said rotatable cutter that extends into said bore and acts to pump lubricant through said passage means.

3. In an earth boring bit, said earth boring bit including a bit body having a bearing pin having an end, a rolling cutter mounted over the end of said bearing pin, bearing means for promoting rotation of said rolling cutter and a seal between said rolling cutter and said bit body, a lubricant circulation system, comprising:

a lubricant reservoir in said bit body;

passage means for channeling lubricant from said lubricant reservoir to said bearing means and separate passage means for channeling lubricant from said bearing means back to said lubricant reservoir;

a bore extending from the end of said bearing pin into said bearing pin, said bore forming a portion of said passage means; and a spiral pumping element extending from said rolling cutter into said bore for circulating lubricant through said passage means, said spiral pumping element being a cylindrical member with a spiral groove.

* * * * *